US005377600A

United States Patent [19]

Speese et al.

[11] Patent Number: 5,377,600

[45] Date of Patent: Jan. 3, 1995

[54] PALLET AND PALLET RUNNER OF CORRUGATED CARDBOARD

[75] Inventors: Scott Speese, Kalamazoo; Gregory Arvanigian, Portage, both of Mich.

[73] Assignee: Arvco Container Corporation, Kalamazoo, Mich.

[21] Appl. No.: 206,896

[22] Filed: Mar. 4, 1994

Related U.S. Application Data

[63] Continuation of Ser. No. 949,726, Sep. 23, 1992, abandoned, which is a continuation-in-part of Ser. No. 823,296, Jan. 21, 1992, abandoned, and a continuation-in-part of Ser. No. 890,550, May 28, 1992, abandoned, which is a continuation-in-part of Ser. No. 823,296, May 28, 1992.

[51] Int. Cl.[6] ..... B65D 19/00

[52] U.S. Cl. ..... 108/51.3

[58] Field of Search ..... 108/51.3, 51.1, 56.1, 108/56.3

[56] References Cited

U.S. PATENT DOCUMENTS

| | | | |
|---|---|---|---|
| 2,928,638 | 3/1960 | Parker | 108/51.3 |
| 2,957,668 | 10/1960 | Norquist et al. | 108/51.3 |
| 3,012,747 | 12/1961 | Greene | 108/51.3 |
| 3,246,824 | 4/1966 | Gardner | 108/51.3 X |
| 3,911,834 | 10/1975 | Quaintance | 108/51.3 |
| 4,875,419 | 10/1989 | Helton et al. | 108/51.3 X |
| 4,966,084 | 10/1990 | Motomaru | 108/51.3 |
| 5,176,090 | 1/1993 | Roberts et al. | 108/51.3 |
| 5,195,440 | 3/1993 | Gottlieb | 108/51.3 |
| 5,272,989 | 12/1993 | Johnston et al. | 108/51.3 |

FOREIGN PATENT DOCUMENTS

| | | | |
|---|---|---|---|
| 784537 | 5/1968 | Canada | 108/51.3 |
| 2215253 | 10/1973 | Germany | 108/51.3 |
| 1144715 | 3/1969 | United Kingdom | 108/51.3 |

*Primary Examiner*—José V. Chen

*Attorney, Agent, or Firm*—Flynn, Thiel, Boutell & Tanis

[57] ABSTRACT

A pallet assembly made of a web of corrugated paperboard and providing a flat deck, a pair of parallel stringers for supporting the pallet on the ground, and flaps associated with the stringer sidewalls and folded to project interiorly of the stringer to strengthen the pallet and form openings for receiving the horizontal support bars of a forklift truck. The pallet assembly may have one or more additional stringers provided thereon. Additional flaps can also be provided to achieve additional strengthening effects. The stringer can be constructed as a separate element for attachment to a suitable deck or box to create a pallet-like construction.

29 Claims, 12 Drawing Sheets

PALLET AND PALLET RUNNER OF CORRUGATED CARDBOARD

CROSS REFERENCE TO RELATED APPLICATION

This application is a continuation of U.S. Ser. No. 07/949,726, filed Sep. 23, 1992 now abandoned, which is a continuation-in-part of copending applications Ser. Nos. 07/823,296 filed on Jan. 21, 1992, and 07/890,550 filed on May 28, 1992, with latter application Ser. No. 07/890,550 being a continuation-in-part of aforementioned Ser. No. 07/823,296.

FIELD OF THE INVENTION

This invention relates to a pallet assembly made of corrugated paperboard, which pallet assembly is suitable for transport by a forklift truck, and to a pallet runner or stringer which is also made of corrugated paperboard.

BACKGROUND OF THE INVENTION

A variety of pallet constructions made of corrugated paperboard and suitable for transport by a forklift truck have been proposed heretofore and examples of such pallets are illustrated by U.S. Pat. Nos. 4,966,084, 4,875,419, 4,867,074, 3,246,824, 3,012,747, 2,957,668 and 2,928,638. Most of these pallet constructions are of complex, multipart construction and it is difficult to manufacture and assemble them. Prior attempts to provide simplified pallet constructions made of corrugated paperboard have resulted in pallet constructions which lack sufficient strength and durability to meet practical requirements for the use of pallets in industrial and commercial operations.

Accordingly, it is an object of this invention to provide an improved pallet assembly made of corrugated paperboard, which pallet assembly is economical to manufacture and is relatively strong and durable so that it can meet practical requirements for use in factories, warehouses and the like.

It is also an object of this invention to provide an improved pallet runner or stringer which is constructed using as its primary structure a one-piece sheet of corrugated paperboard, which runner is economical to manufacture and relatively strong and durable so that it can meet practical requirements for use in factories, warehouses and the like, and which is suitable for use with a forklift truck.

SUMMARY OF THE INVENTION

According to one embodiment of the invention, there is provided a pallet assembly made of a monolithic web of corrugated paperboard which is cut, scored, folded and erected to define a pallet having a pair of parallel, spaced-apart, elongated end stringers which serve as ground-engaging members of the pallet, said pallet also having a flat upper deck extending between the end stringers and forming the top side of the pallet assembly. The stringers are of hollow, rectangular cross-section. The two sidewalls of each stringer each have at least two pairs of rectangular flaps which are hingedly connected along one vertical edge thereof to the sidewall of the stringer while the remaining edges thereof are defined by cut lines so that the flaps can be bent to extend at a right angle to the sidewall of the stringer. The flaps on at least one, and preferably both, of the sidewalls are folded inwardly to effectively transversely cross the interior of the respective stringer. The upper and lower edges of the flaps are adapted to substantially contact the underside of the deck and the upper walls of the stringers, respectively, so the load on the deck is transmitted to the bottom wall of the stringers whereby to provide effective support for the load on the deck. The pairs of overlapped flaps define two aligned openings through each stringer with the openings in the stringers being aligned with each other so as to provide two elongated passageways into which the horizontal, load-supporting bars of a forklift truck can be extended so that the pallet assembly can be lifted by a forklift truck.

According to a modification of the invention, a bottom support panel is secured to and extends between the bottom walls of the stringers to maintain same in an erected condition and to provide improved strength.

In another modification of the invention, a third support stringer is provided approximately midway between the two end stringers and extends substantially parallel therewith to provide support for the central portion of the deck of the pallet assembly. The third stringer has pairs of flaps provided therein and forming openings like those in the end stringers so that the horizontal support bars of a forklift truck can be extended therethrough for the same purposes as discussed above. In this modification, a bottom support panel is not required.

In a further modification of the invention, a pair of additional end flaps are provided at opposite ends of the sidewalls of the end stringers and are joined thereto by a vertical fold. These two end flaps are bent so that they project inwardly into the interior of the end stringer from the open end thereof, with the end flaps being bent inwardly so as to project at an angle of approximately 45° relative to the sidewall, whereby the pair of opposed end flaps define an angle of about 90° therebetween when bent inwardly into the stringer. These end flaps are sized so that free vertical edges thereof are positioned directly adjacent one another when the end flaps are folded inwardly into the stringer whereby these end flaps thus define a generally L-shaped column which extends between the top and bottom walls of the stringer to provide significant additional column strength adjacent the corners of the pallet.

In another modification of the invention, a pair of additional flaps are provided in the inner sidewalls of the two end stringers. The additional flaps can be bent so as to extend at a right angle to the inner wall and to extend between the bottom surface of the pallet deck and the upper surface of the bottom wall of the stringers whereby to transfer the load on the pallet to the bottom wall of the stringers. The additional pair of flaps provides additional reinforcement and strength to the stringers. The additional pair of flaps can also be provided in the third stringer when that stringer is used.

In a still further and preferred modification of the invention, the pallet has the flat upper deck thereof formed from a monolithic one-piece blank of corrugated paperboard, and has a pair of edge stringers secured to the underside thereof adjacent opposite edges thereof. A third or center stringer can also be secured to the underside of the top deck if desired. Each of these stringers is preferably constructed from a separate monolithic one-piece blank of corrugated paperboard. Each of the blanks defining the stringers is appropriately scored and folded to define a generally hollow but elongate tube, with one sidewall of the tube being defined by overlapping walls which are adhesively secured together. A top wall of the tube is then adhesively secured to the underside of the upper deck. Each of the stringers has at least two pairs of rectangular flaps associated with each sidewall thereof and hingedly connected along vertical edges, with remaining edges of the flaps being defined by cut lines so that the flaps can be bent to extend transversely to the respective sidewall of the stringer. The flaps are bent inwardly into the hollow interior of the respective stringer to substantially contact and provide vertical support between the upper and lower walls of the stringer, and at the same time define transverse openings which extend in aligned relationship through the stringers for accommodating the load-support bars of a forklift truck. Each of the stringers may also be provided with additional vertical reinforcement by provision of hollow cylindrical support tubes positioned within but adjacent each end of the stringer. The support tubes supportingly engage the upper and lower walls of the stringer, and have a diameter substantially corresponding to the interior width of the stringer. The support tubes, preferably constructed of paper, are adhesively secured within the stringer.

In another and preferred modification of the invention, a runner or stringer for a pallet is preferably constructed from a separate monolithic one-piece blank of corrugated paperboard, which blank is folded to define a generally hollow elongate tube, with the top wall of the tube being adapted for securement to the underside of a pallet deck. The stringer is preferably constructed in the manner as described above so that flaps which define forklift receiving openings are folded inwardly for supportive engagement between top and bottom walls of the stringer tube. These flaps, in a preferred variation, have an interlock structure to hold the flaps interiorly of the tube so that they extend generally transversely across the tube interior.

In another modification of the invention, the pallet, as aforesaid, is integrated into a bin structure. The bin structure includes top and bottom closures each having foldable tubular rims which telescope over opposite ends of an intermediate tubular sidewall structure, the latter also being collapsible. The lower closure also has the pallet fixedly and permanently joined thereto, which pallet includes two or more generally parallel and horizontally elongate stringers which project downwardly from the lower closure part to enable the bin to be supported on a floor or similar surface, and at the same time permit engagement with the lifting tines of a conventional forklift. The sidewall structure and closures are each constructed in one piece of corrugated cardboard.

BRIEF DESCRIPTION OF THE DRAWINGS

Referring to the drawings.

Figure 1:
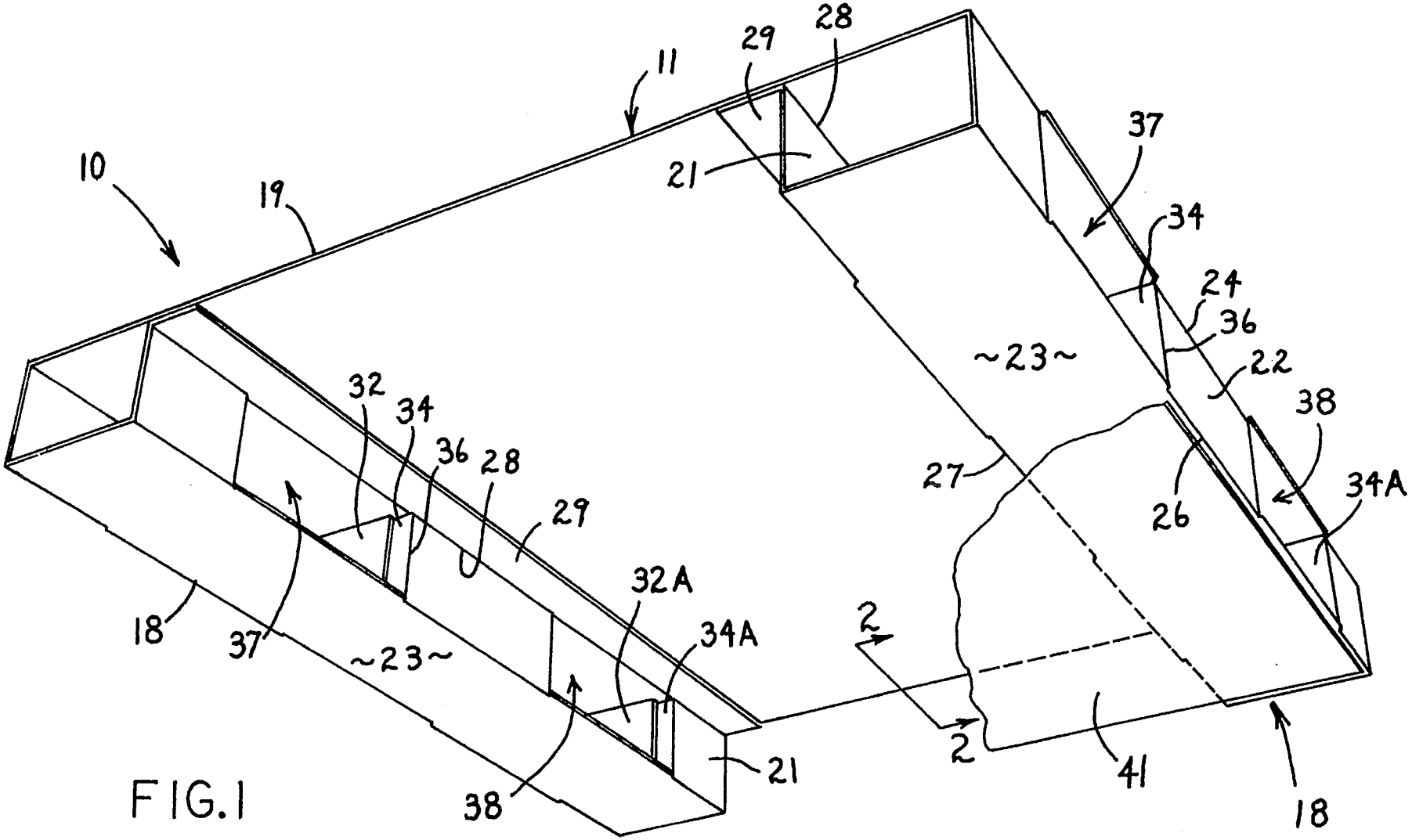
FIG. 1 is a bottom perspective view of a first embodiment of the improved pallet assembly according to the invention.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the structure and designated parts. Said terminology will include the words specifically mentioned, derivatives thereof, and words of similar import.

DETAILED DESCRIPTION OF THE INVENTION

Figure 2:
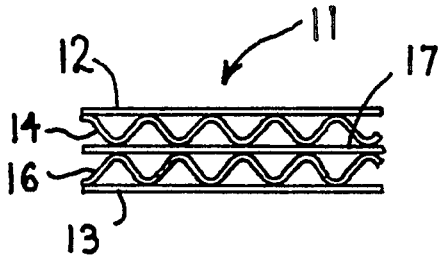
FIG. 2 is a cross-sectional view taken along the line II—II in FIG. 1.
Figure 3:
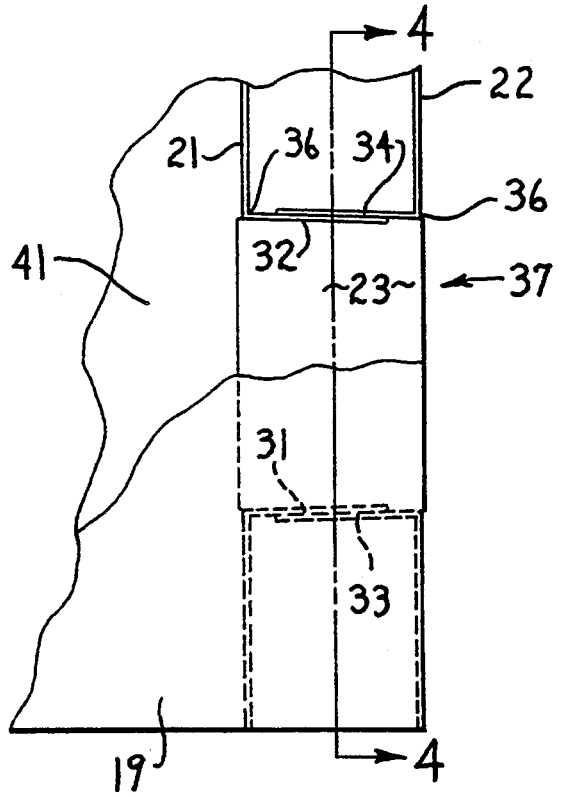
FIG. 3 is a top plan view of a corner of the pallet assembly of FIG. 1, with a portion of the top deck being broken away.
Figure 4:
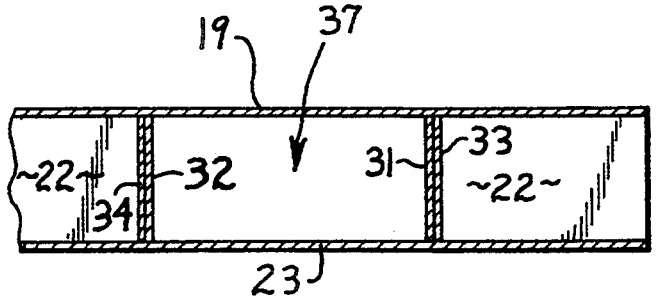
FIG. 4 is a sectional view taken along the line IV—IV in FIG. 3.

According to an embodiment of the invention shown in FIGS. 1–4, there is provided a pallet assembly 10 made of a monolithic, one-piece web 11 of corrugated paperboard. Preferably, as shown in FIG. 2, the web 11 is made of double wall corrugated board composed of outer liners 12 and 13, corrugating boards 14 and 16, and an intermediate liner 17 between the corrugating boards.

The web 11 is cut, scored, folded and erected to form the pallet assembly 10 comprised of a pair of parallel, spaced-apart, elongated edge stringers or runners 18 and a flat deck or support surface 19 extending between the stringers 18 and providing the top, load-supporting surface of the pallet assembly.

Each of the stringers 18 is of hollow, rectangular cross-section. Each stringer 18 is comprised of an upright inner sidewall 21, an upright outer sidewall 22 and a flat horizontally extending bottom wall 23 which is adapted to rest on a support surface such as a floor. The upper edge of the outer sidewall 22 is hingedly connected to the adjacent edge of the deck 19 by a fold line 24. The bottom edge of the outer sidewall 22 is hingedly connected to the adjacent edge of the bottom wall 23 by a fold line 26. The bottom edge of the inner sidewall 21 is hingedly connected to the inner edge of the bottom wall 23 by a fold line 27. The upper edge of the inner sidewall 21 is hingedly connected by a fold line 28 to a flange 29 which extends parallel with and is adhesively affixed to the bottom surface of the deck 19.

Two pairs of rectangular flaps 31, 32 and 33, 34 are provided at corresponding locations on the outer and inner walls 22 and 21 of each of the stringers 18 and close to the respective longitudinal ends thereof. Two additional pairs of rectangular flaps 31A, 32A, 33A and 34A are provided in corresponding fashion close to the other longitudinal end of the stringers 18. Each of the flaps 31–34 and 31A–34A has an outer edge connected by a fold line 36 to the remainder of its associated wall, which fold line 36 extends vertically when the pallet is fully assembled in its use condition. The remaining three edges of each of the flaps 31–34 and 31A–34A are defined by cut lines. Each flap can be bent around its fold line 36 so as to extend transversely and at a right angle in the illustrated embodiment to its associated wall 21 or 22 in a direction extending crosswise of and located internally of the stringer 18.

The flaps 32 and 34 are preferably inwardly folded into overlapping engagement as described above, and may be secured in that condition by gluing and/or stapling, if desired, but such securing is normally not required since the upper and lower edges of the flaps substantially contact the respectively opposed surfaces of the top and bottom walls of the stringer to hold the flaps in the desired inwardly-folded position. The respective pairs of flaps 31, 33; 31A, 33A; and 32A, 34A are similarly folded and overlapped.

Figure 7:
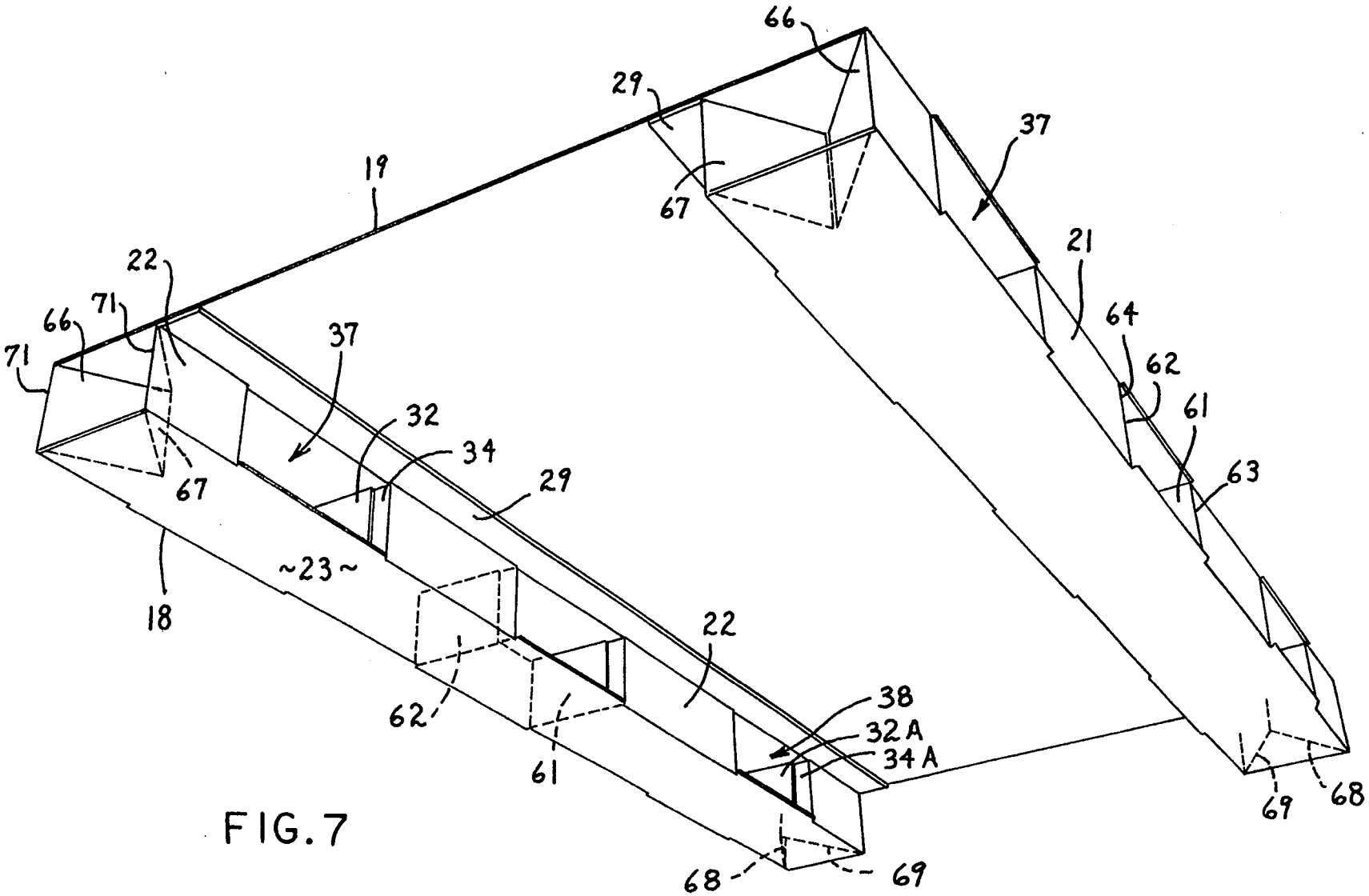
FIG. 7 is a perspective view, like FIG. 1, and showing a third embodiment of the invention in which a pair of additional flaps are formed on the inner wall of each of the stringers.
Figure 8:
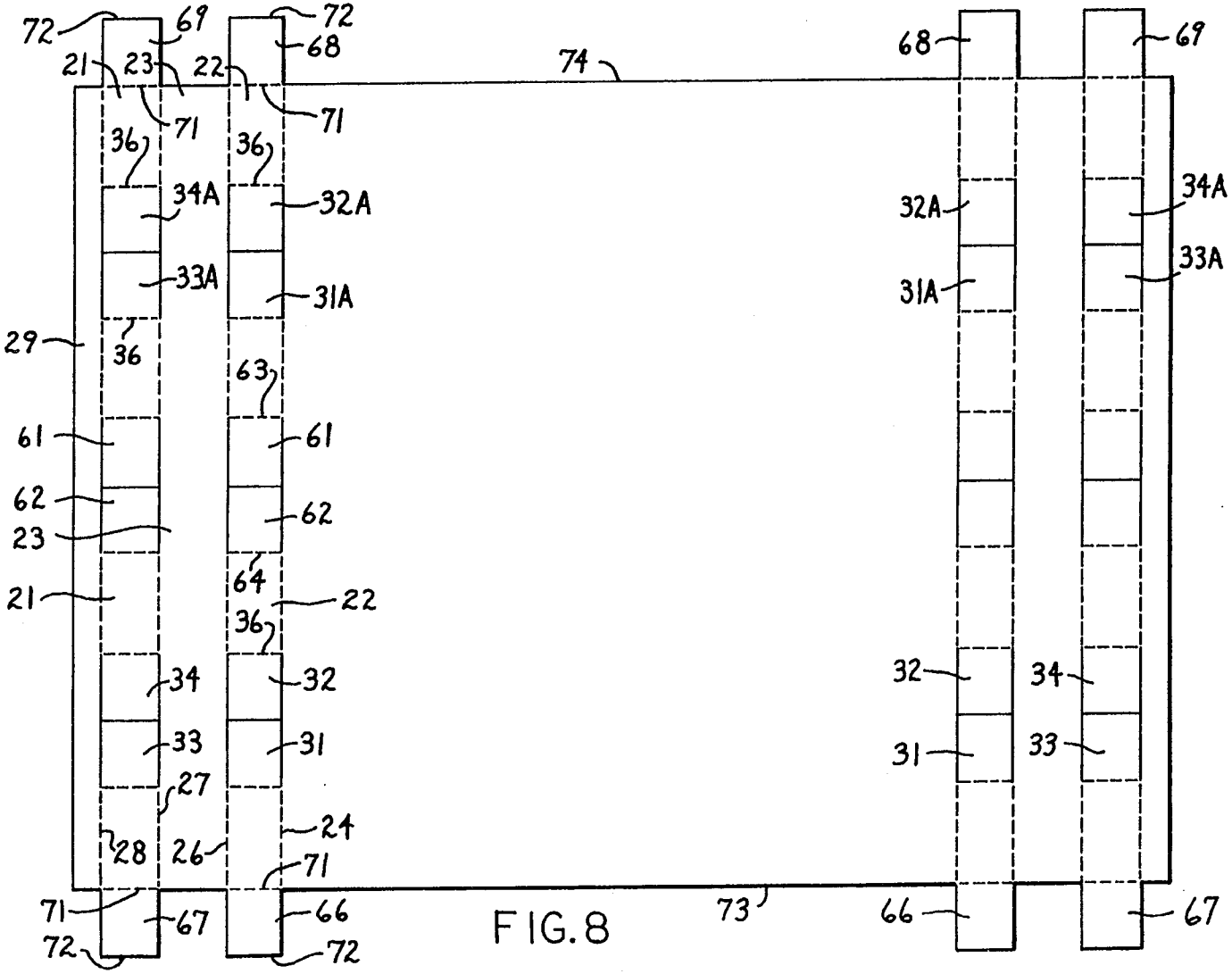
FIG. 8 is a plan view of the blank used to make the pallet construction illustrated in FIG. 7.

The stringers 18 can be flattened until the time that the flaps 31–34 and 31A–34A are folded inwardly around their respective fold lines. Thus, in the manufacture of the pallet assembly from a blank substantially as shown in FIG. 7, the stringers 18 can be formed and the flanges 29 thereof can be attached to the deck of the pallet assembly, following which the stringers 18 can be flattened. The pallet assembly, at this time, is in a relatively flat condition and can be shipped to the customer in that way, thereby conserving shipping space. When the customer desires to use the pallet, the stringers 18 can be erected and then the flaps 31–34 and 31A–34A can be folded inwardly as described above whereby to rigidify the stringers 18 and prevent unintentional collapsing thereof. If desired, the customer can erect the pallet from a flat blank, substantially as shown in FIG. 8.

The pairs of flaps 31, 33; 31A, 33A; 32, 34; and 32A, 34A form a pair of through passages 37 and 38 which extend through the stringers 18. The through passages 37 and 38 are spaced apart a distance corresponding to the spacing between the horizontal support bars of a forklift truck so that such support bars can be extended through the openings 37 and 38 in order that the pallet assembly and the load supported thereon can be transported by the forklift truck.

In FIG. 1, there is illustrated the provision of a bottom panel 41 which extends between and is secured, as by an adhesive, to the bottom walls 23 of the stringers 18. The bottom panel 41 is parallel with the top deck 19 and is effective to increase the pallet strength. The bottom panel 41 can be of one-piece cardboard construction, that is, it can be a single panel, or it can be a plurality of separate pieces extending between the bottom walls 41 of the stringers 18. The bottom panel 41 is not always necessary and it is an optional feature of the invention.

Figure 5:
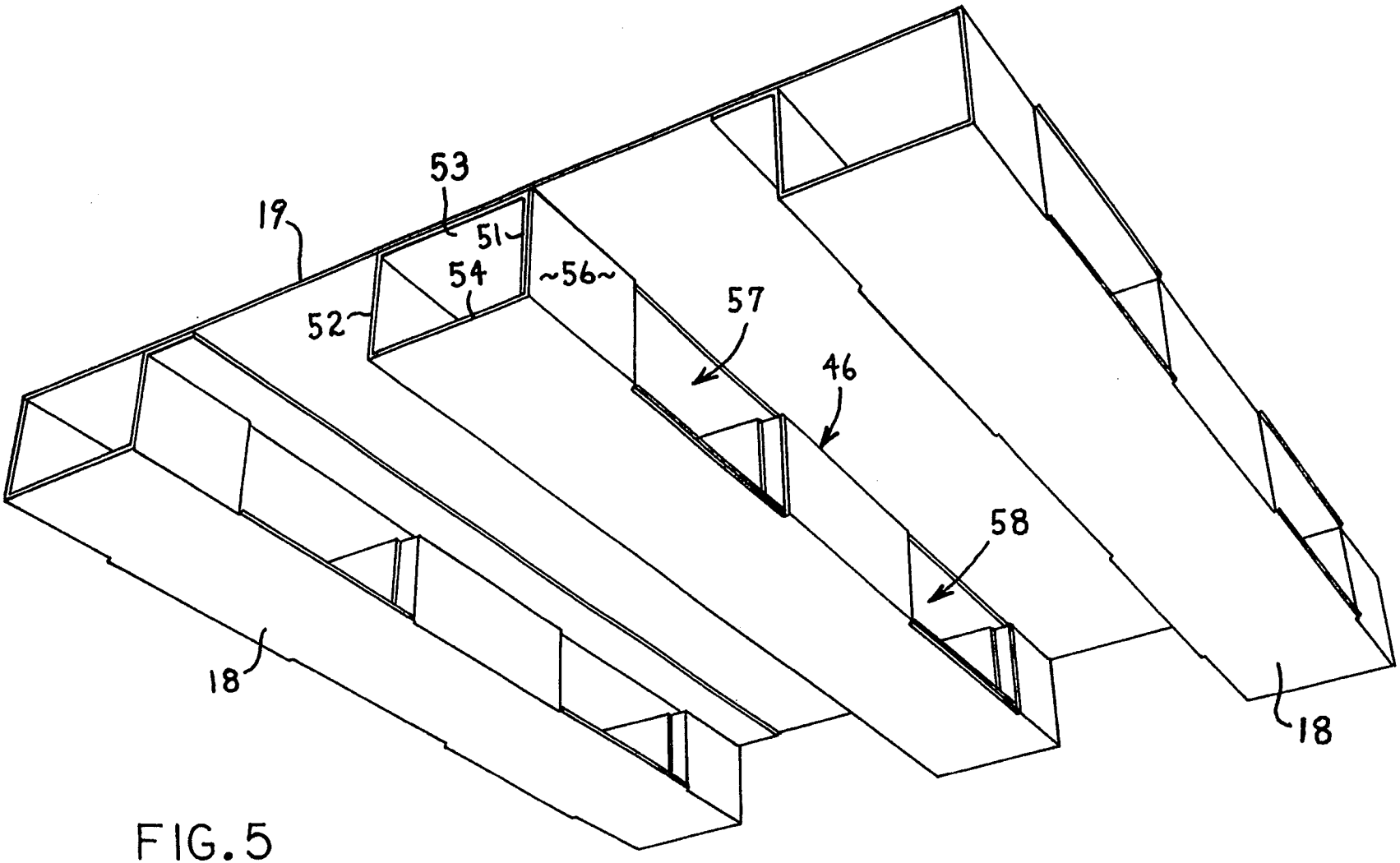
FIG. 5 is a perspective view, like FIG. 1, and showing a second embodiment of the invention in which a third stringer member is employed.
Figure 6:
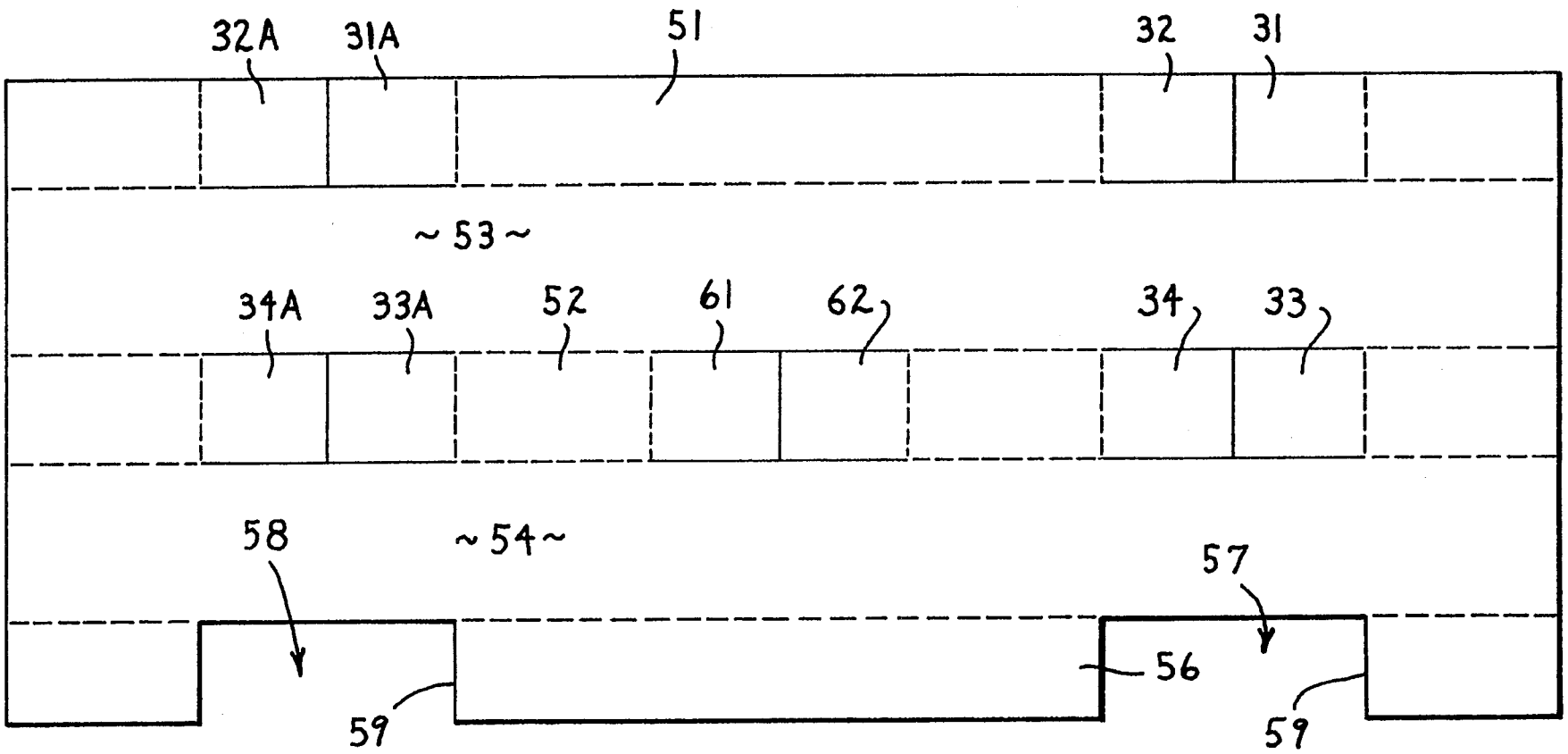
FIG. 6 is a plan view of the blank used to make the third stringer member illustrated in FIG. 5.

FIG. 5 shows a modification in which a third stringer 46 of hollow, rectangular shape is attached to the underside of the deck 19 approximately midway between the two end stringers 18, 18 and extends substantially parallel therewith. The monolithic one-piece blank of corrugated paperboard from which the third runner 46 is made is illustrated in FIG. 6. The third runner 46 is comprised of sidewalls 51, 52 and bottom wall 54, which are like the corresponding walls 21, 22 and 23 of the stringers 18. The third runner has a top wall 53 which is adhesively secured to the underside of the top deck 19, and an end wall 56 which overlaps and is adhesively secured to the sidewall 51. Through openings 57 and 58 are provided by flaps 31–34, 31A–34A in the third runner 46 in the same way as the openings 37 and 38 are provided in the runners 18. The end wall 56 has elongated notches 59 which permit access to the flaps.

The third runner 46, when folded and adhesively secured to form a hollow tube of rectangular cross-section, which tube is then adhesively secured to the top deck, provides additional support for the load on the deck 19, particularly the load in the central portion of the deck.

Referring to FIGS. 7 and 8, in another modification of the invention, in order to provide additional support at a location between the openings 37 and 38 in the stringers 18, there can be provided an additional pair of rectangular flaps 61 and 62 in outer sidewall 22 at a location approximately midway between the openings 37 and 38. Corresponding flaps are also preferably provided in the inner sidewall 21. The flaps 61 and 62 are connected to the sidewalls 21 and 22 by fold lines 63 and 64. The other edges of the flaps 61 and 62 are defined by cut lines so that the flaps 61 and 62 can be folded inwardly of the stringer so as to extend substantially at right angles to the walls 21 and 22 and to extend between the lower surface of the deck and the upper surface of the bottom wall 23 so as to transfer the load on the deck to the bottom wall of the pallet construction.

As shown in FIG. 6, the additional flaps 61 and 62 can also be provided in the third stringer 46 when the pallet construction employs the third (i.e. center) stringer.

As also shown in FIGS. 7 and 8, the pallet of this invention may also incorporate therein additional flaps for providing additional column or crush strength adjacent the ends of the stringers, particularly those ends which effectively define the corners of the pallet. For this purpose, each end of the stringer is provided with a further pair of cooperating foldable flaps, namely the flaps 66 and 67 at one end of the stringer, and the flaps 68 and 69 at the other end of the stringer. Each of these flaps is joined to the end edge of the respective stringer sidewall by a fold line 71, and each flap terminates in a free edge 72 which is formed substantially parallel with the fold line 71. These flaps 66, 67, 68 and 69, when the basic structural unit of the pallet is in the form of a flat one-piece blank as illustrated by FIG. 7, project outwardly beyond the respective parallel side edges 73 and 74 of the blank, which edges 73 and 74 define the respective side edges of the pallet when assembled. The fold lines 71 are effectively align with and constitute an extension of the respective side edges 73 and 74.

When the pallet blank of FIG. 8 is folded and assembled so as to create the pallet as illustrated by FIG. 7, the cooperating pairs of end flaps 66–67 and 68–69 are folded inwardly toward one another about the upright fold lines 71 through angles substantially in excess of 90° so that the flaps 66, 67, 68 and 69 all project interiorly into the open end of the respective tubular stringer whereby each of the flaps extends at an acute angular relationship relative to the respective sidewall. Each cooperating pair of flaps, such as flaps 66 and 67, are folded inwardly in angled relationship to one another and relative to the sidewalls so that the free edges of the flaps 72 substantially contact one another, whereby the cooperating pair of flaps such as 66 and 67 define a V-shaped wall or column which projects inwardly from the open end of the stringer, with this V-shaped column extending across the width of the stringer and substantially vertically between the top and bottom walls thereof so as to provide significant stiffening and strength at the end of the stringer, and particularly in the vicinity of the corner of the pallet. The apex of this V-shaped arrangement, namely the region where the free edges 72 of the cooperating pair of flaps substantially meet, is preferably disposed in close association with the inwardly-folded pair of flaps such as flaps 31 and 33.

In the pallet of the present invention, as described above, the flaps associated with one sidewall of each stringer must be folded inwardly so as to extend traversely, such as substantially perpendicularly, across the interior of the stringer to hence provide a rigid boxlike construction so as to sustain the pallet load. While it is preferable to also fold the flaps on the other sidewall inwardly to maximize the column or crush strength of the pallet, nevertheless these outer flaps can in some cases not be folded in, but rather will be folded outwardly due to insertion of the forklift support bars through the openings.

Because the fundamental structural unit of the pallet construction (i.e. the top deck and end stringers) is made of a one-piece monolithic web of corrugated paperboard, the pallet can easily be manufactured in a plant of the type conventionally used for making corrugated products, such as boxes. The pallet assembly can be shipped to the customer in a flattened condition, a partially erected or a fully erected condition. In the former cases, the customer will readily be able to complete the erection of the pallet at the point of use. The pallet construction is simple and inexpensive to make and it can easily be recycled. The pallet can be provided with additional strengthening means so that it can be made to have selectably variable load capacities.

Figures 9, 10, 11:
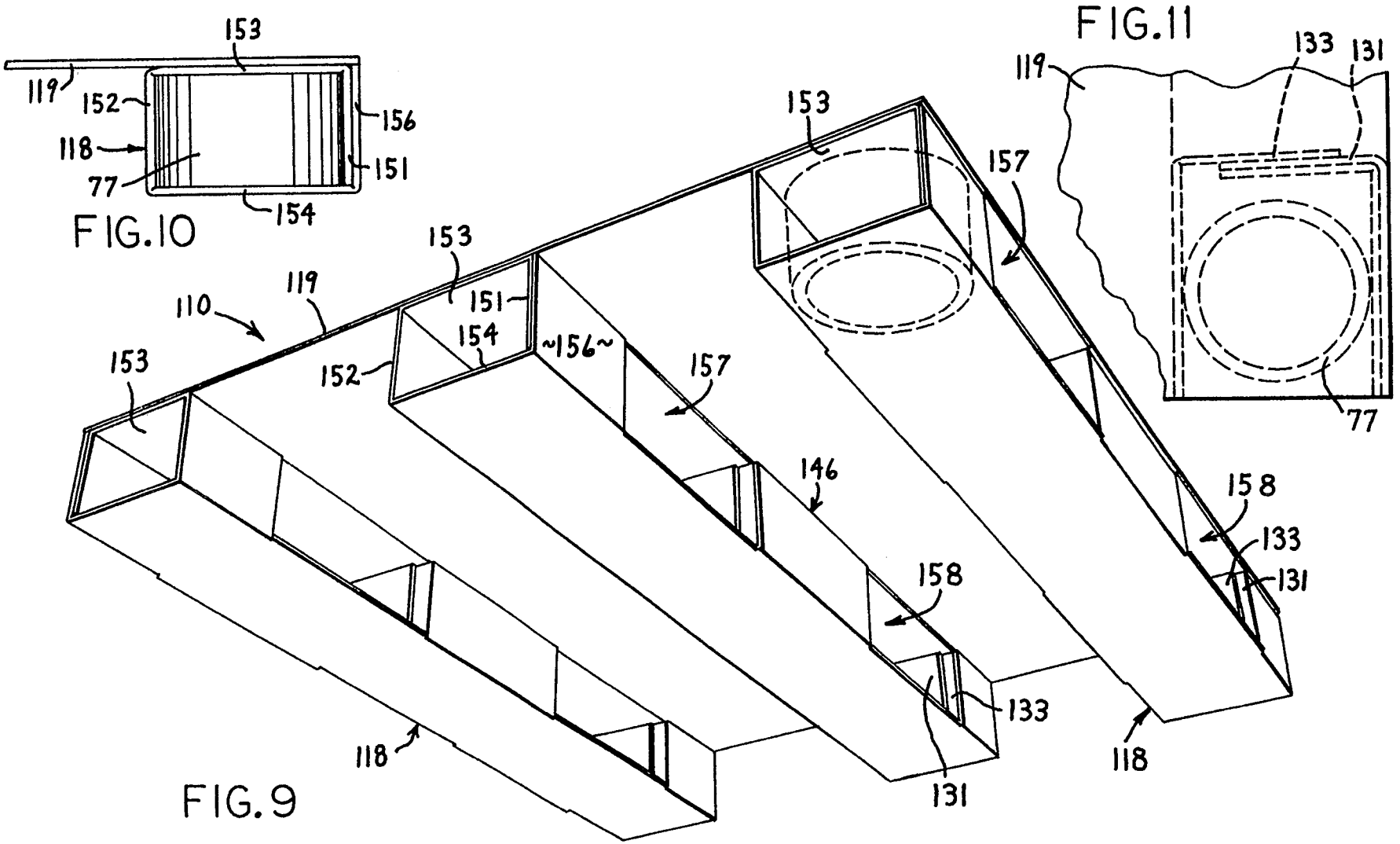
FIG. 9 is a bottom perspective view like FIG. 1 but showing a fourth embodiment of the invention in which each of the stringers is constructed from a separate blank.
FIG. 10 is a fragmentary end view showing the open end of one stringer and its connection to the top deck.
FIG. 11 is a fragmentary top view showing the corner of the pallet corresponding to that illustrated in FIG. 10.

FIGS. 9–11 illustrate a pallet of corrugated paperboard construction according to another modification of the invention. The modified pallet of FIGS. 9–11 incorporates therein many of the same parts and constructional features described above, and hence these corresponding parts have been identified in FIGS. 9–11 with the same reference numerals except that these numerals have been increased by "100".

The pallet 110 of FIG. 9 includes a top deck 119 formed from a monolithic one-piece blank of corrugated paperboard. This deck has a pair of parallel and horizontally elongated edge stringers 118 secured to the underside thereof adjacent opposite free edges of the deck, and each of these stringers 118 is also individually constructed from a separate monolithic one-piece blank of corrugated paperboard. The pallet 110 may also be optionally provided with a center stringer 146 positioned parallel with and midway between the end stringers 118, which center stringer 146 is substantially identical to the edge stringers 118 and is also constructed from a separate monolithic one-piece blank of corrugated paperboard.

In the pallet 110, each of the stringers 118 and 146 is constructed from a one-piece blank so as to have constructional features substantially identical to the blank illustrated in FIG. 6, so that additional detailed description of the construction and structure of the stringers 118 and 146 is believed unnecessary. Each of these stringers has the top wall 153 thereof adhesively secured to the underside of the top deck 119. Further, one sidewall of each stringer is of a generally two-ply construction in that it is defined by overlapping of the sidewalls 156 and 151, which sidewalls are adhesively secured together. This latter two-ply sidewall is preferably positioned so as to be the outermost side of the stringers 118, namely positioned substantially directly under the free edge of the top deck 119, since this sidewall can normally be expected to encounter greater abuse in use, and hence this two-ply construction provides greater durability.

Each of the stringers 118 and 146 also has the aligned openings 157 and 158 formed therethrough for accommodating the load-supporting elements of a forklift, with the openings in the individual stringers being defined by the foldable flaps (such as the flaps 31–34 in FIG. 6) so as to extend inwardly and generally perpendicularly across the interior of the respective stringer, with the flaps having a height substantially equal to the height of the hollow interior of the stringer to provide vertical load support for the stringer. That is, the height of the flaps is such that the upper and lower edges of the flaps substantially contact the opposed surfaces of the respective top and bottom walls of the tubular stringer to hence provide a structural vertical column directly between the top and bottom walls of the stringer to provide significantly increased load capacity. Further, due to the contact between the upper and lower edges of the transversely folded flaps and the opposed top and bottom walls of the stringer, a frictional holding relationship is created due to this contact which basically holds the flap inwardly in its folded position so as to prevent the flap from tending to fold outwardly due to the memory which typically exists when folds are created in corrugated paperboard.

In addition, while the pallet 110 of FIG. 9 is illustrated as having only two transverse openings 157 and 158 associated therewith, it will be appreciated that the pallet, depending on size and load requirements thereof, can also be provided with a third transverse opening associated with the stringers, with the third transverse opening in each stringer having foldable flaps associated therewith, which flaps correspond to the flaps 61 and 62 illustrated in FIGS. 6–8 as described above.

The pallet 110 described above is particularly desireable from the standpoint of economy of construction and material. The top deck 119 can be formed from a single generally rectangular flat blank, which forming can be substantially without waste, and without requiring any scoring or folding. Each of the stringers 118 and 146 can also be formed in their entirety from a single flat rectangular blank so as to permit economy of material use since the blank can be suitably scored and cut while having only minimal material waste, namely removal of the material for the notches 59 (FIG. 6) associated with the one sidewall. Further, constructional economies are further increased by the fact that each of the stringers 118 and 146 utilizes an identical cut and scored blank.

To provide the pallet 110 with additional load-supporting capacity and hence vertical strength, if desired, each corner of the pallet can be provided with a reinforcing element 77 disposed adjacent each corner of the pallet. This reinforcing element 77 comprises a hollow tube, preferably of paper, and preferably of circular cross-section. This cylindrical tube 77 is preferably positioned closely adjacent each free end of end stringer 118 with the support tube 77 having a height which substantially equals the interior height of the stringer tube so that upper and lower ends of the support tube 77 hence supportingly engage the top and bottom walls of the stringer. This support tube 77 also preferably has an outer diameter which substantially equals the interior horizontal width of the stringer as defined between opposed sidewalls 51 and 52 so as to hence substantially totally occupy the cross-section of the stringer to prevent collapsing thereof and hence provide greatly increased vertical compression strength. The support tube 77 is preferably adhesively secured within the stringer, although in some instances the tube may be satisfactorily held within the stringer solely due to a snug or interference fit with the inner walls of the stringer. The support tube 77 is preferably provided adjacent opposite free ends of each end stringer 118, and a further pair of support tubes 77 are also preferably provided adjacent opposite free ends of the center stringer 146 when the latter is provided on the pallet.

Figure 12:
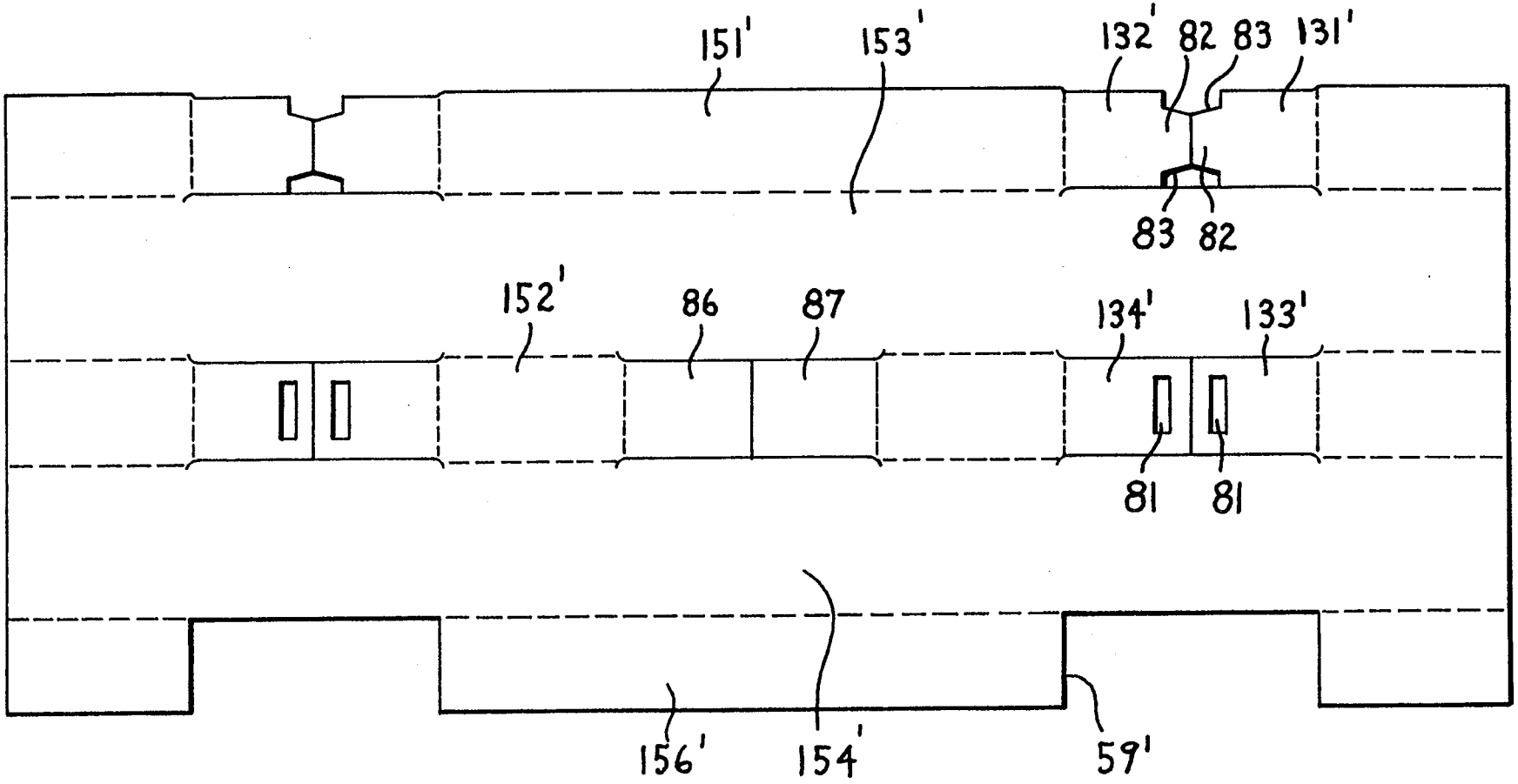
FIG. 12 is a plan view similar to FIG. 6 but illustrating a blank used to construct a variation of the pallet stringer.
Figure 13:
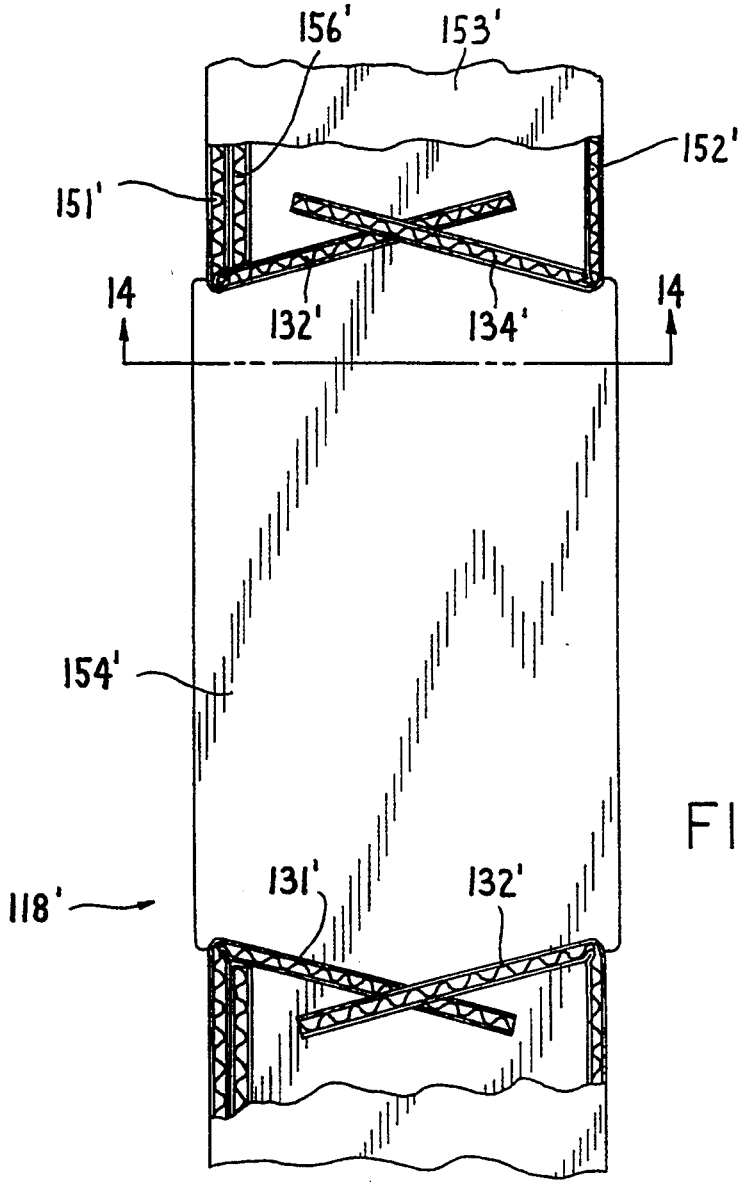
FIG. 13 is a fragmentary top plan view of the pallet stringer as assembled from the blank of FIG. 12, with a portion of the top wall of the stringer broken away to illustrate the construction thereof.
Figure 14:
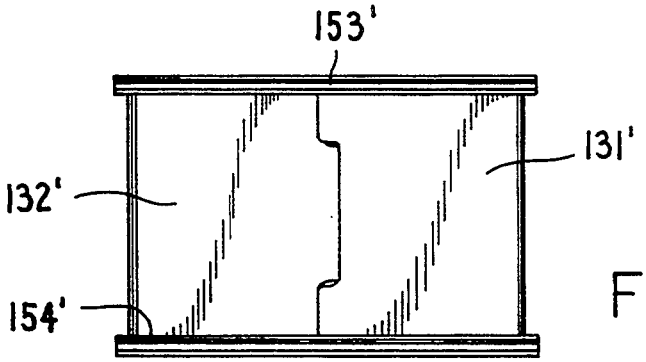
FIG. 14 is a cross sectional view taken substantially along line 14—14 in FIG. 13.

Referring now to FIGS. 12–14, there is illustrated a preferred construction of the pallet stringer which is again formed primarily from a one-piece flat, monolithic blank of corrugated paperboard which is suitably scored and cut so as to be folded into a hollow tube of generally rectangular cross section. This blank as illustrated by FIG. 12 can be utilized for forming each of the pallets stringers, such as the stringers 118 and 146 as illustrated by FIG. 9. Hence, the blank includes suitable fold and score lines so as to define the parallel top and bottom walls 153' and 154', respectively, of the tube defining the stringer, these latter walls being joined through fold lines to the generally parallel sidewalls 151' and 152'. A further end wall 156' is foldably hinged to the bottom wall 154' so as to overlap the sidewall 151' when the blank is assembled to form the tubular stringer.

Each sidewall again has at least a pair of sidewardly-spaced openings for accommodating forklift tines, with each opening again being defined by a pair of cooperating foldable flaps 131', 132' and 133', 134'. The end flap 156' also has openings 59' cut therein for alignment with the openings formed in the sidewalls when the blank is assembled to form the tubular stringer.

In this construction of the stringer, the flaps 131'–134' are provided with cooperating holding or interlocking structure to positively retain the flaps in the folded open position. This interlocking structure is defined by openings 81 as defined in each of the flaps 133' and 134' adjacent the free edge thereof, and tabs or projections 82 as defined at the free edge of the flaps 131' and 132'. These latter projections 82 are defined by suitable cuts 83 as formed in the flat blank so as to reduce the width of the flaps 131' and 132' adjacent the free end thereof. When the opposed flaps 131'–132' and 133'–134' are folded so as to project transversely into the interior of the stringer tube, the opposed pair of overlapping flaps 132', 134' and the other pair 131', 133' mechanically interlock due to the projection or tab 82 on one flap being inserted into and projecting through the opening 81 formed through the opposed flap. This positively maintains the folded flaps in the open position substantially as illustrated by FIGS. 13 and 14, and positively prevents the flaps from folding outwardly so as to interfere with the transverse opening through the stringer. This interlocking of the flaps not only effectively prevents any tendency of the flaps to return to the flat condition due to the inherent memory of the corrugated paperboard, but also prevents any tendency for the flaps to fold outwardly such as may be caused by movement or handling of the pallet.

In addition to the interlock between the cooperating pairs of flaps, the flaps are again provided with a height which substantially corresponds to the height between the top and bottom walls of the tubular stringer, whereby the top and bottom edges of the flaps when folded transversely into the interior of the tube are respectively engaged with the top and bottom walls of the tube, thereby creating a frictional holding engagement which tends to prevent the flaps from swinging outwardly, and at the same time providing for desirable vertical column support between the top and bottom walls of the stringer. The mechanical interlock between the cooperating pairs of flaps is also believed to provide for more desirable vertical column strength between the top and bottom walls of the tubular stringer.

With the stringer construction using the blank of FIG. 12, the blank is folded to form a rectangular cross section tube and, in this variation of the invention, the end flap 156' is folded inside the tube so as to overlap and be adhesively secured to the sidewall 151', although it will be appreciated that the end flap 156' can exteriorly overlap the sidewall if desired. The stringer can then be suitably attached to any suitable pallet deck, such as by an adhesive securement of the top wall of the stringer to a deck. Alternatively, these stringers can be utilized by a user by purchasing solely the stringer, and then attaching the stinger to the bottom wall of a shipping container such as a corrugated box, thereby effectively creating a palletized shipping container.

The improved stringer illustrated by FIGS. 12–14 can also be provided with additional foldable flaps associated with one or both sidewalls 151' and 152', such as illustrated by flaps 86–87, to provide additional vertical column support for the stringer at a location midway between the forklift openings. The stringer can also be provided with additional reinforcing load-transfer vertical supports, such as by providing the ends of the stringer with support tubes similar to the tubes 77 (FIGS. 9–11) if desired.

The blanks used for constructing the pallet of the present invention are all preferably constructed from what is commonly known as double-faced corrugated. Such corrugated, as is well known, employs a center fluted or corrugated layer having flat facing sheets bonded to opposite sides thereof. To construct the pallet of this invention, the blank defining the top deck 19 or 119 is preferably oriented so that the elongated direction of the flutes extends perpendicularly between the lengthwise extent of the end stringers 18 or 118 so as to optimize the strength of the top deck. Similarly, in forming each of the stringers, the elongated direction of the flutes in the blank defining each stringer preferably extends perpendicularly between the fold lines, and this hence results in the elongated direction of the flutes extending vertically in the sidewalls of the stringer when folded into the rectangular tubular shape.

Figure 15:
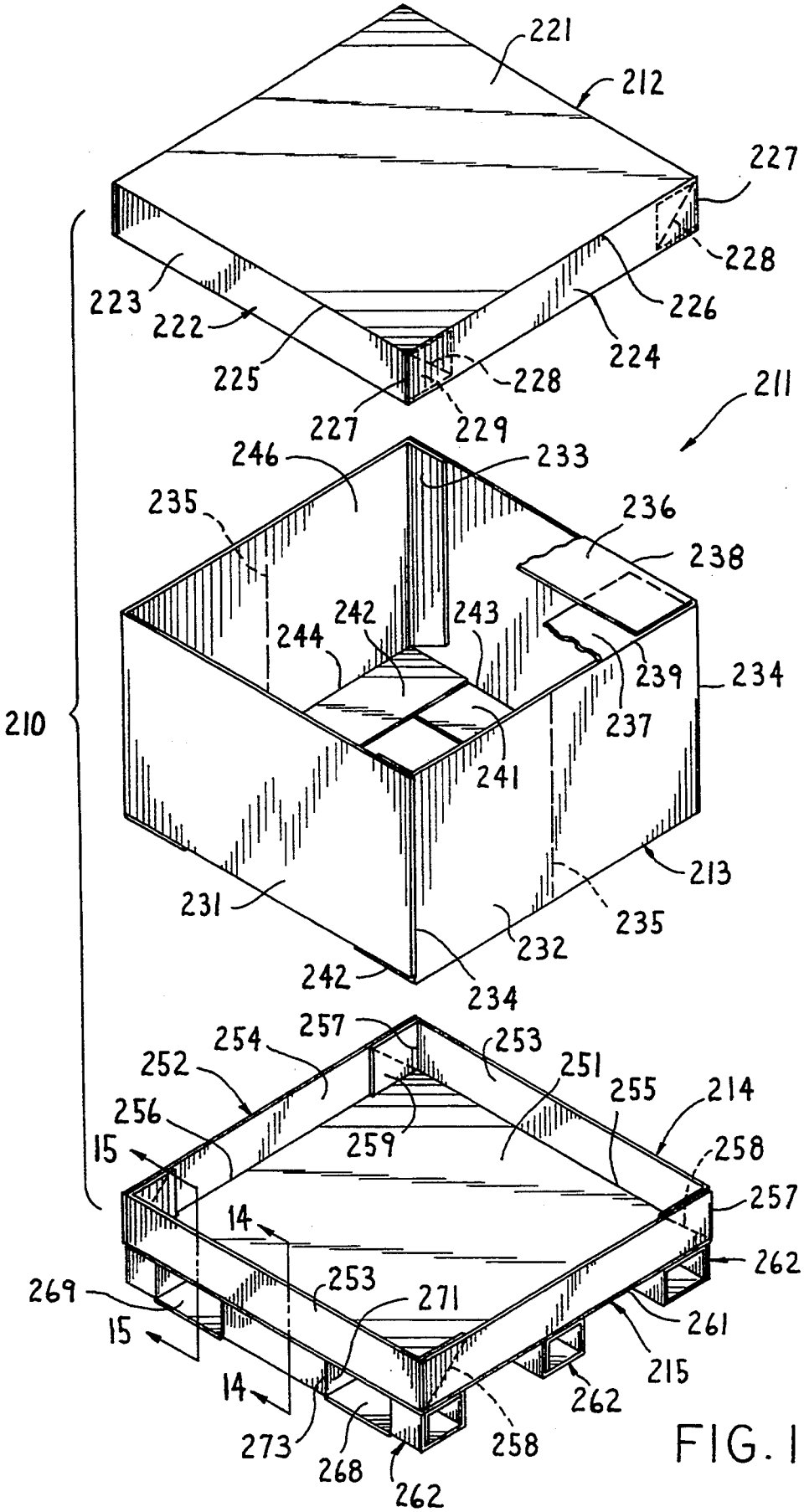
FIG. 15 is an exploded perspective view illustrating the improved pallet of the present invention integrated into a bin structure.

Referencing now FIGS. 15–19, there is shown a storage bin 210 which integrates therein a pallet constructed as aforesaid. FIG. 15 illustrates the storage bin structure 210 in an assembled condition, with the same bin structure being illustrated in a collapsed condition in FIG. 16. The bin structure 210 includes a main storage bin or box 211 which is defined by a removable top closure 212, an intermediate tubular sidewall structure 213, and a lower closure 214, the latter being removably engageable with the lower end of the intermediate sidewall structure 213. These three parts 212–214, when assembled, and engaged together, define a generally closed boxlike structure which is of generally rectangular cross-section in both vertical and horizontal cross-sectional directions.

The bin structure 210 also includes a support pallet 215 fixedly and integrally joined to the lower closure 214. The lower closure 214 and pallet structure 215 hence define a single part, whereby the entire bin/pallet structure 210 is thus defined by only three separable parts, namely the upper closure part 212, the intermediate sidewall structure or part 213 and the lower closure/support pallet part 214–215. All of these parts are constructed substantially entirely of double-faced corrugated cardboard, as explained in detail below.

Figure 16:
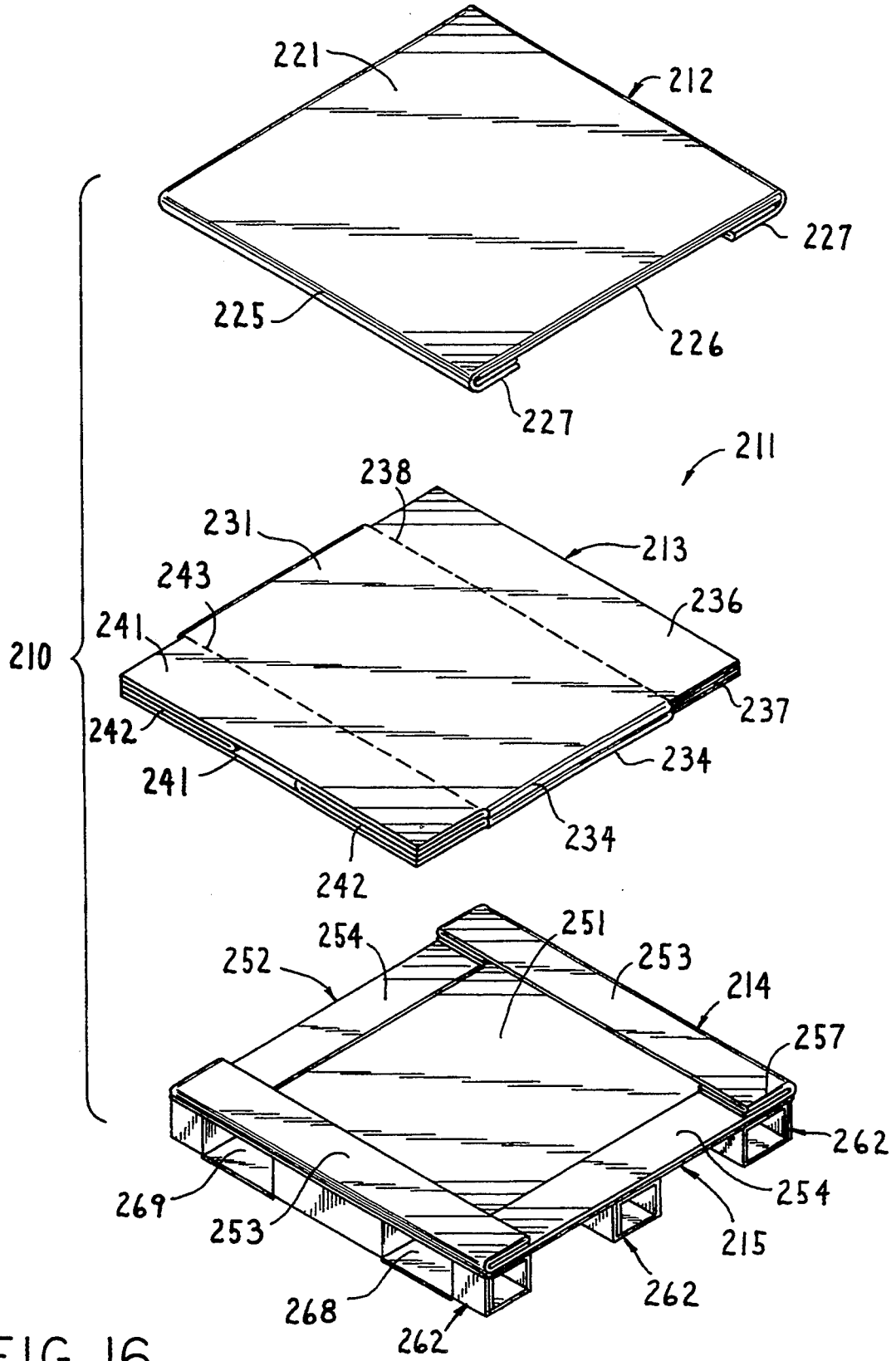
FIG. 16 is a view similar to FIG. 15 but showing the various parts of the bin structure in a collapsed condition.
Figure 17:
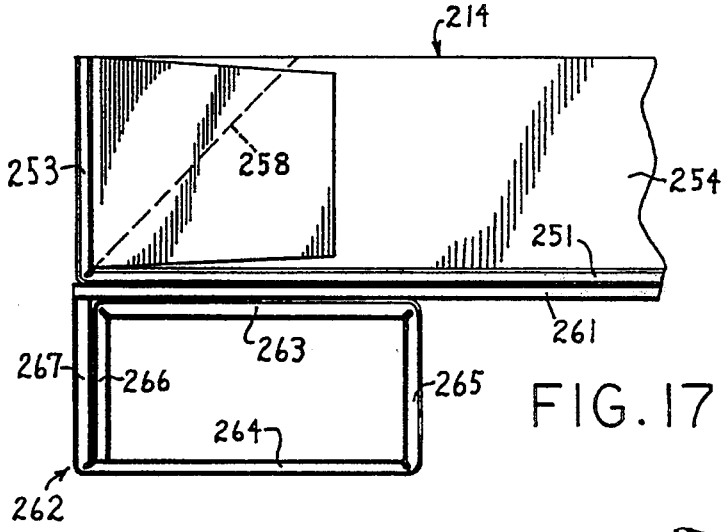
FIG. 17 is an enlarged, fragmentary sectional view taken substantially along line 17—17 in FIG. 15.
Figure 18:
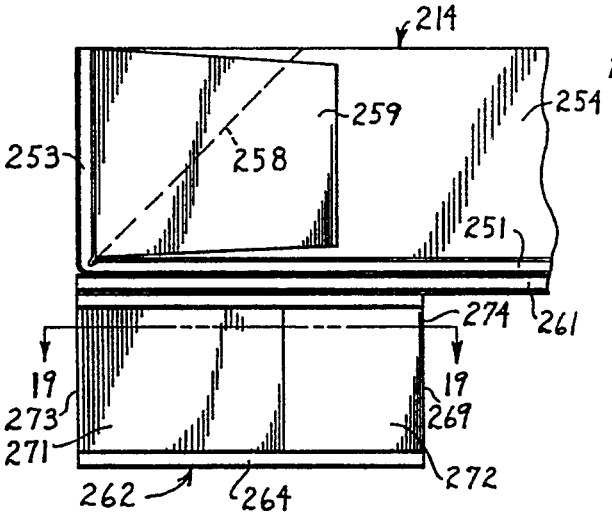
FIG. 18 is an enlarged, fragmentary sectional view taken substantially along line 18—18 in FIG. 15.

Considering first the top closure part 212, it includes a horizontally enlarged platelike top wall 221 of generally rectangular configuration. A tubular rim 222 is joined to the outer peripheral edge of the top wall 221 and projects vertically downwardly therefrom. This tubular rim 222 is defined by an opposed pair of first side flaps 223 which extend in parallel relationship and project downwardly from opposite sides of the top wall, with the first side flaps extending perpendicularly between a pair of second side flaps 224 which extend in parallel relationship and project downwardly from the remaining pair of side edges of the top wall 221. The first and second side flaps 223 and 224 are respectively joined by horizontal fold lines 225 and 226 to the edges of the top wall 221. Each adjacent pair of side flaps 223 and 224 are also joined together by a corner fold line 227 which projects vertically when the top closure part is assembled. A further fold line 228 is associated with each side flap 224 in the vicinity of the corner fold 227, with this fold line 228 projecting outwardly from the corner fold 227 at an angle of about 45° so as to enable the tubular rim 222 to be collapsed or folded into a generally flat condition whereby the flaps 223 and 224 generally overlap and lie parallel with and substantially flat against the top wall 221, substantially as illustrated by FIG. 16.

The top closure part 212 is preferably constructed in one piece from a flat blank of double-faced corrugated cardboard, which blank is suitably cut and scored so as to define the top wall 221 and the side flaps 223 and 224 integrally joined thereto through the intermediate fold lines 225 and 226. The side flaps 223 are also preferably provided with corner flaps 229 joined to the ends thereof through the corner fold lines 227. Flaps 229 are folded inwardly and adhesively secured to the inner surfaces of the adjacent end portions of the side flaps 224 so that the resulting tubular rim 222 is thus of a closed endless configuration which is substantially rectangular in cross-section when assembled. The score or fold lines 228 are formed in both the corner flaps 229 and the overlapping end portions of the side flaps 224 to permit substantially flat collapsing of the top closure part 212. The cooperating fold lines 227 and 228 enable the side flaps 224 to be initially folded inwardly so as to lie directly against the undersurface of the top wall 221, with the remaining side flaps 223 then being folded inwardly so as to be flat against and underlie the other flaps 224, thereby providing a flat and very compact structure when the top closure part 212 is in the collapsed or nonassembled condition so as to facilitate shipping, handling and storage.

The intermediate sidewall structure or part 213, as illustrated by FIG. 15, includes a pair of opposed and generally parallel first sidewalls 231 which are joined together by a pair of opposed and generally parallel second sidewalls 232, the latter extending generally perpendicularly between the first sidewalls 231 when the sidewall part 213 is in the assembled condition. In this assembled condition, all of the sidewalls 231 and 232 project generally vertically in an upright condition, and all are of generally rectangular configuration.

The sidewall part 213 is preferably constructed of one-piece by being suitably cut and scored from a flat blank of double-faced corrugated cardboard. For this purpose, and to permit creation of a tubular sidewall structure which is endless in horizontal cross-section, the one sidewall 232 is provided with an edge flap 233 which overlies and is adhesively secured to the inner surface of the adjacent end portion of the one sidewall 231. Each adjacent pair of sidewalls 231 and 232 is joined together by a vertically extending corner fold 234. Each of the opposed vertical sidewalls 232 also preferably has a further vertical fold line 235 extending throughout the height thereof substantially midway between the adjacent corner folds 234. The folds 234 and 235 result in the sidewall part 213 being what is conventionally referred to as a six-fold tube since this enables the sidewalls 235 to be folded inwardly toward one another so that the two parts of each sidewall 232 hence fold directly into engagement with one another, with the remaining sidewalls 231 then folding inwardly onto the inwardly folded sidewalls 232, thereby providing a flat and compact collapsed structure as illustrated by FIG. 16.

The sidewall part 213, in the illustrated embodiment, also includes first and second top flaps which are joined to upper edges of each of the sidewalls 231 and 232, respectively. These first and second top flaps 236 and 237 are joined through respective horizontal fold lines 238 and 239 to the respective upper edge of the sidewall.

Similarly, first and second bottom flaps 241 and 242 are respectively joined by horizontal fold lines 243 and 244 to the lower edges of each of the respective sidewalls 231 and 232.

The top and bottom flaps 236–237 and 241–242, respectively, are provided so as to create additional strength and stability when the sleeve part 213 is in an upright assembled condition as illustrated by FIG. 15, and for this reason the top and bottom flaps do not necessarily have to project across the entire width of the open upper and lower ends of the sidewall part. In fact, as illustrated by FIG. 15, the top and bottom flaps 236–237 and 241–242 each have a width, as measured perpendicularly away from the respective fold line, which is significantly less than one half of the corresponding width of the open end of the sleeve part since these flaps do not function as closures, this latter function being provided by the closure parts 212 and 214.

The sleeve part 213, when in the upright assembled condition illustrated by FIG. 15, defines therein an interior storage compartment 246, the upper and lower ends of which are suitably closed by the top and bottom closure parts.

Considering now the bottom closure part 214, it is constructed substantially identical to the top closure part 212 in that it is also formed in one piece from a flat blank of double-faced corrugated cardboard which is suitably cut and scored so as to permit formation of the lower closure part. In fact, the lower closure part is initially constructed identical to the upper closure part.

More specifically, the lower closure part includes a substantially horizontally enlarged bottom wall 251 of generally rectangular configuration, the latter having a generally tubular rim 252 projecting upwardly from the periphery of the bottom wall when the bottom part is in an assembled condition. This tubular rim includes an opposed pair of first side flaps 253 which extend generally parallel, and an opposed pair of generally parallel second side flaps 254, with the latter flaps 254 extending perpendicularly between and joined to the ends of the side flaps 253 through suitable corner folds 257. The side flaps 253 are joined to opposed edges of the bottom wall 251 through horizontal fold lines 255, and in a similar fashion the side flaps 254 are joined to the other pair of opposed side edges of the bottom wall 251 through horizontal fold lines 256. The ends of the side flaps 253 have corner flaps 259 joined thereto through the respective corner fold, and these corner flaps 259 overlap and are adhesively secured to the inner surfaces of the adjacent end portions of the side flaps 254. Fold lines 258 are formed through the corner flaps 259 and the overlying portions of the side flaps 254, which fold lines 258 project from the inner corner upwardly at an angle of about 45° so as to terminate at the free edge of the side flap 254.

With this construction of the bottom closure part 214, the side flaps 254 can be folded inwardly and downwardly so as to directly overlie the bottom wall 251, and the remaining side flaps 253 can then be folded downwardly and inwardly so as to directly overlie the side flaps 254, thereby creating a flat and collapsed lower closure part having a structure which is substantially identical to the upper closure part as described above.

Each of the upper and lower closure parts 212 and 214, when the tubular rims 222 and 252 are in the assembled position illustrated by FIG. 15, have a rectangular interior cross-section defined within the rim which is substantially equal to the exterior rectangular cross-section of the tubular sleeve part 213 when assembled. This hence enables the upper and lower ends of the assembled tubular sleeve part 213 to slidably telescope into the rims defined on the upper and lower closure parts, which rims hence exteriorly overlie the sidewall part 213 to define a closed box structure.

According to the present invention, the lower closure part 214 also has the support pallet 215 fixedly and permanently joined thereto. This support pallet 215 includes a top wall 261 which is constructed as a one-piece member of double-faced corrugated cardboard sized so as to have a horizontal rectangular cross-section substantially identical to the bottom wall 251, with this top wall 261 being positioned directly under and adhesively secured to the top wall 251 so that these walls 251 and 261 hence effectively define a two-ply laminate.

The pallet structure also includes at least two, in the illustrated embodiment three, stringers 262 disposed in parallel relationship so as to extend horizontally under and project downwardly from the top wall 261. Two of the stringers 262 are disposed so as to be closely adjacent opposite side edges of the top wall 261, and the third stringer 262 is positioned horizontally substantially midway between the outermost stringers.

Each stringer 262 includes generally parallel and horizontally extending top and bottom walls 263 and 264, joined together by generally parallel upright sidewalls 265 and 266, whereby the stringer hence comprises a hollow tube having a generally rectangular vertical cross-section. The stringer is preferably constructed in one-piece from a flat blank of double-faced corrugated cardboard, which blank is suitably cut and scored so as to enable the stringer to be folded into the desired hollow tubular cross-section. The blank used for forming the stringer is preferably provided with an additional upright sidewall 267 which directly overlaps and is secured, as by an adhesive, to the adjacent upright sidewall 266, which sidewalls 266 and 267 define the free edge portions of the blank prior to folding, so as to provide the stringer with additional strength and rigidity. The upright sidewall defined by the two-ply construction of the sidewalls 266 and 267 is preferably provided outermost relative to the overall arrangement so as to provide increased durability against external damage.

Each stringer 262 is provided with a pair of openings 268 and 269 disposed in spaced relationship longitudinally along the sidewall of each stringer, which openings 268 and 269 open inwardly through each upright sidewall 265 and 266–267, With the openings in the opposed sidewalls of one stringer being directed aligned with one another, and these openings in one stringer in turn being aligned with similar openings formed in the sidewalls of the remaining stringers. These aligned openings 268 and 269 hence extend through all three stringers and enable the tines of a lift fork to be inserted therethrough for handling of the assembly. Alternatively, the tines of the lift fork can be inserted into the spaces located between the stringers if desired.

In construction of the stringers 262 and of the openings 268–269, each opening 268 and 269 is preferably defined by a pair of opposed flaps 271 and 272 which are initially formed as part of the respective upright sidewall. These flaps 271 and 272 are suitably formed by scorelines which extend along the upper and lower edges thereof, and also along mutually adjacent vertical edges. The opposed remote vertical edges of the flaps 271 and 272 are defined by vertical fold lines 273 and 274 which join the flaps to the respective upright sidewall.

Figure 19:
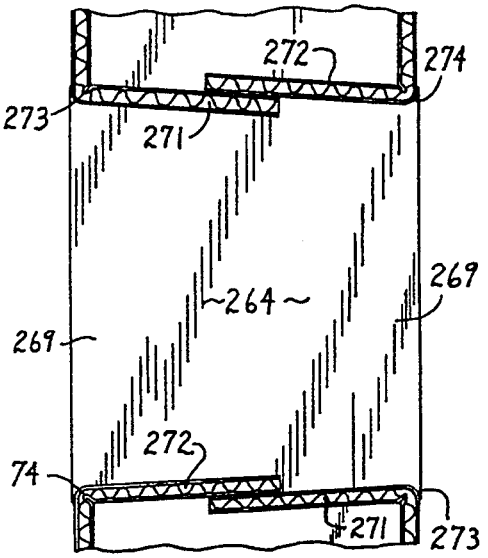
FIG. 19 is a fragmentary sectional view taken substantially along line 19—19 in FIG. 18.

The flaps 271 and 272 have a height which substantially corresponds to the interior height of the tubular cross-section of the stringer, and hence the flaps 271 and 272 can be folded transversely inwardly in substantially perpendicular relationship to the respective sidewalls so as to substantially extend across the width of the tubular cross-section, substantially as illustrated by FIG. 19, to hence define through openings for accommodating the tines of the lift fork. The flaps 271 and 272, when in the open position illustrated by FIG. 19, hence substantially supportingly engage the top and bottom walls of the stringer and provide increased vertical stacking strength.

Figure 20:
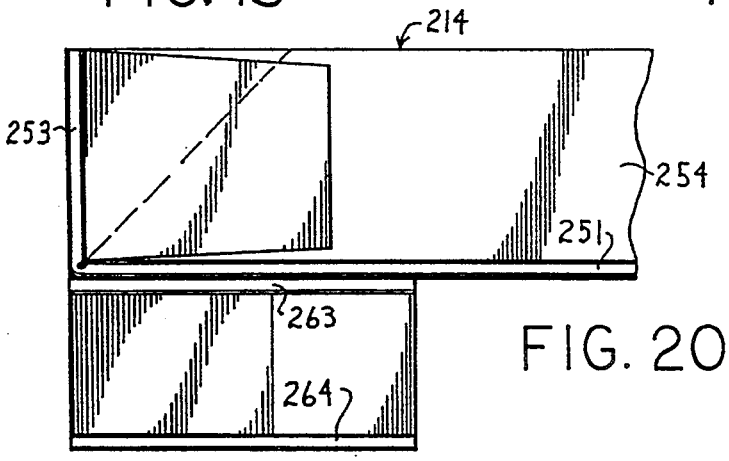
FIG. 20 is a view similar to FIG. 18 but illustrating a variation.

The stringers 262 are preferably initially formed and adhesively secured to the top wall 261, with the latter thereafter being fixedly and adhesively secured to the bottom wall 251, both for convenience of construction and for increased strength and durability. However, it will be appreciated that the construction of the invention can also be in accordance with the modified arrangement illustrated by FIG. 20. As this latter modification illustrates, the intermediate top wall 261 is eliminated, and instead the top walls 263 of the stringers are adhesively secured directly to the underface of the bottom wall 251 of the lower closure part 214.

The construction of the support pallet 215 and particularly the construction of the stringers 262 substantially corresponds to and is described in greater detail above relative to FIGS. 9–14.

With the improved box/pallet structure 210 of the present invention, the entire structure 210 can be constructed entirely from flat blanks of corrugated cardboard. For example, the top closure part 212, the sidewall part 213 and the bottom closure part 213 are each constructed in one piece of corrugated cardboard. Similarly, as to the support pallet 215, the top wall 261 is constructed as a one-piece corrugated member, and each of the stringers 262 is also constructed as a one-piece corrugated member. Further, the pallet is adhesively secured and hence becomes fixedly joined to and constitutes an integral part of the lower closure part 214. Thus, when fully manufactured, the overall bin/-pallet structure 210 consists solely of three separate parts or structures as illustrated by FIGS. 15 and 16. Further, these three separate structures can be collapsed into very flat and compact structures as illustrated by FIG. 16, whereby the three parts can be vertically stacked together and then suitably banded or handled in whatever manner is most desirable so as to provide a compact collapsed structure which is highly desirable for both shipping, handling and storage.

On the other hand, when use of the structure 210 is desired, then the upper and lower closure parts 212 and 214 can be easily assembled merely by outwardly folding the tubular rims, and by unfolding the sidewall part so as to create the upright tubular structure. The lower end of the tubular structure is then inserted into the tubular rim 252 of the lower closure part 214, following which the compartment 246 can be loaded with goods or product. The top flaps 236–237 are then folded inwardly, and the top closure part 212 telescoped downwardly over the upper end of the tubular sleeve part 213 so as to totally close off the structure 210. The structure can then be banded or shrinkwrapped if desired.

When in the closed position, the structure 210 can be easily handled by a hand truck or a forklift, the tines of which can be inserted into the support pallet from any side, such as into the spaces between the stringers, or through the aligned openings 268–269.

After the structure 210 has been unloaded, then the three parts can again be collapsed into the position illustrated by FIG. 16 and stacked so as to permit storage and subsequent use.

The improved arrangement hence permits not only efficient handling, shipping and storing of a three-part collapsible bin, particularly in those situations where such bins are reused, but at the same time provides the bin with its own integrated pallet which can also be compactly stored during periods of use and nonuse, and when the bin is both assembled and collapsed, to hence avoid the necessity of having to both handle and store separate pallets and bins.

Although particular preferred embodiments of the invention have been described, the invention contemplates such changes or modifications therein as lie within the scope of the appended claims.

The embodiments of the invention in which an exclusive property or privilege is claimed are defined as follows:

1. A pallet assembly constructed substantially entirely of corrugated paperboard, comprising a pair of parallel, spaced-apart, elongated end stringers each being defined by a monolithic one-piece blank of corrugated paperboard cut, scored, folded, and erected to define a substantially hollow, rectangular cross-section comprised of two, spaced-apart, parallel, opposed vertical sidewalls with a top wall extending substantially horizontally between upper edges of said sidewalls and a bottom wall extending substantially horizontally between lower edges of said sidewalls and extending substantially parallel with said top wall, and a substantially flat top deck extending substantially horizontally between said end stringers and fixedly joined to the top walls thereof, said top deck comprising a monolithic one-piece blank of corrugated paperboard, said stringers projecting downwardly from said top deck, said two sidewalls of each stringer each having two pairs of rectangular flaps bounded by two upright fold lines along mutually remote upright edges thereof and cut lines along adjacent upright edges thereof and along upper and lower edges thereof, said flaps being foldably positioned in an inwardly folded position so as to extend substantially transversely of their respective sidewalls inside said stringer so as to be disposed in overlapping and abutting relationship and to extend between and provide vertical load support between said top and bottom walls, said pairs of overlapping flaps defining two aligned openings through each said stringer, each opening in one stringer being aligned with a corresponding opening in the other stringer, and the pairs of aligned openings in said stringers being spaced-apart a distance corresponding to the spacing between the support bars of a forklift truck so that the pallet assembly can be lifted by a forklift truck.

2. A pallet assembly according to claim 1, wherein the blanks defining said end stringers and the blank defining said top deck are all defined by a single monolithic one-piece master blank of corrugated paperboard which is scored and folded so that the stringers are integrally and monolithically joined to the top deck, the top walls of the stringers being coplanar and integrally and monolithically joined to and constituting a part of the top deck.

3. A pallet assembly as claimed in claim 2, wherein an inner sidewalls of each said end stringer has a flange extending from an upper end thereof and connected thereto by a fold line, said flange being disposed adjacent to the underside of said deck and extending parallel therewith and fixedly secured thereto, said end stringers being foldable with respect to said flanges and said deck into a position in which the stringers are collapsed and the parts thereof extend substantially parallel to said deck.

4. A pallet assembly according to claim 1, wherein each of said end stringers is constructed from a separate and distinct one-piece blank of corrugated paperboard, and the top wall of each said end stringer is disposed in engagement with and fixedly secured to an underside of said top deck.

5. A pallet assembly according to claim 4, including interlock means cooperating between the opposed overlapping flaps when disposed in the interior of the stringer for securing the overlapping flaps together in the inwardly folded position.

6. A pallet assembly according to claim 4, wherein each said flap has a height which substantially corresponds to the interior vertical spacing between the top and bottom walls of the stringer so that upper and lower edges of the flap are disposed in contact with the respective opposed top and bottom walls of the stringer when the flap is folded into the interior of the stringer.

7. A pallet assembly as claimed in claim 1, including a pair of cooperating rectangular end flaps associated with each end of each said end stringer, each said end flap being joined to an end edge of a respective said sidewall by an upright fold line, the remaining edges of the end flap being free edges, whereby the cooperating pair of end flaps can be folded inwardly into the open end of the end stringer so that the pair of cooperating end flaps extend in angled relationship relative to one another and relative to the opposed sidewalls so that the cooperating end flaps have the free upright edges thereof disposed adjacent one another and the cooperating end flaps define a generally V-shaped upright column which extends between the deck and the bottom wall.

8. A pallet assembly as claimed in claim 1, in which the opposed sidewalls of each said stringer each has a third pair of rectangular flaps disposed approximately midway between said two pairs of flaps, said third pair of flaps being bounded by two upright fold lines along mutually remote upright edges thereof and cut lines along adjacent upright edges thereof and along upper and lower edges thereof whereby the third pair of flaps can be folded so as to extend substantially transversely of their respective sidewalls inside said stringer so as to be disposed in overlapping relationship and to extend between said deck and said bottom wall in vertical load supporting engagement therewith.

9. A pallet assembly according to claim 1, including vertical reinforcing means provided inside each of said end stringers adjacent the ends thereof, said vertical reinforcing means being disposed between the sidewalls of the respective stringer and extending vertically between the top and bottom walls thereof for providing vertical support therebetween, said vertical support means comprising a substantially hollow cylindrical tube constructed of paper, said cylindrical tubed being vertically oriented and positioned interiorly of the stringer adjacent an end thereof so that the tube has upper and lower ends which are maintained substantially in engagement with the respective top and bottom walls of the stringer.

10. A pallet assembly according to claim 1, including vertical reinforcing means provided inside each of said end stringers adjacent the ends thereof, said vertical reinforcing means being disposed between the sidewalls of the respective stringer and extending vertically between the top and bottom walls thereof for providing vertical reinforcing therebetween, the vertical support means including flaps secured to the sidewalls of the stringer at the ends thereof with said flaps being folded horizontally inwardly into the end of the stringer to create substantially direct supportive engagement between the top and bottom walls thereof.

11. A pallet assembly according to claim 1, wherein the blank defining each said end stringer includes first and second generally parallel end edges and first, second, third and fourth generally parallel but sidewardly spaced score lines disposed between and extending generally parallel with the end edges, said blank defining a first sidewall extending from said first end edge to said first fold line, one of said top and bottom walls extending between said first and second fold lines, a second said sidewall extending between said second and third fold lines, the other of said top and bottom walls extending between said third and fourth fold lines, and a securing flap extending between said fourth fold line and said second end edge, said blank being folded into a generally hollow rectangular tube so that said securing flap overlaps said first sidewall and is fixedly secured thereto, said securing flap having openings therein which align with the corresponding openings formed in the sidewalls of the stringer.

12. A pallet assembly according to claim 1, including interlock means cooperating between the opposed overlapping flaps when disposed in the interior of the stringer for securing the overlapping flaps together in the inwardly folded position.

13. A pallet assembly according to claim 1, wherein each said flap has a height which substantially corresponds to the interior vertical spacing between the top and bottom walls of the stringer so that upper and lower edges of the flap are disposed in contact with the respective opposed top and bottom walls of the stringer when the flap is folded into the interior of the stringer.

14. A horizontally elongated stringer such as for a pallet, constructed substantially entirely of corrugated paperboard, comprising a monolithic one-piece blank of corrugated paperboard cut, scored, folded, and erected to define a substantially horizontally elongate, substantially hollow tube of rectangular cross-section comprised of two, spaced-apart, parallel, opposed upright sidewalls with a top wall extending substantially horizontally between upper edges of said sidewalls and a bottom wall extending substantially horizontally between lower edges of said sidewalls and extending substantially parallel with said top wall, said two sidewalls each having two pairs of rectangular flaps bounded by two upright fold lines along mutually remote upright edges thereof and cut lines along adjacent upright edges thereof and along upper and lower edges thereof, said flaps being foldably positioned in an inwardly folded position so as to extend substantially transversely of their respective sidewalls inside said stringer so as to be disposed in overlapping and abutting relationship and to extend between said top and bottom walls in vertical load supporting relation therebetween, said pairs of overlapping flaps defining two openings which extend sidewardly through said stringer, the openings in said stringer being spaced-apart a distance corresponding to the spacing between the support bars of a forklift truck so that the stringer can be lifted by a forklift truck.

15. A stringer according to claim 14, including vertical reinforcing means provided inside said tube adjacent the ends thereof, said vertical reinforcing means being disposed between the sidewalls of the stringer and extending vertically between the top and bottom walls thereof for providing vertical support therebetween.

16. A stringer according to claim 15, wherein said vertical reinforcing means comprises a substantially hollow cylindrical tube constructed of paper, said cylindrical tube being vertically oriented and positioned interiorly of the stringer adjacent an end thereof so that the tube has upper and lower ends which are maintained substantially in engagement with the respective top and bottom walls.

17. A stringer according to claim 15, wherein the vertical reinforcing means includes flaps secured to the sidewalls of the stringer at the ends thereof with said flaps being folded horizontally inwardly into the end of the stringer to create substantially direct supportive engagement between the top and bottom walls thereof.

18. A stringer according to claim 14, wherein the blank defining said stringer includes first and second generally parallel end edges and first, second, third and fourth generally parallel but sidewardly spaced score lines disposed between and extending generally parallel with the end edges, said blank defining a first said sidewall extending from said first end edge to said first fold line, one of said top and bottom walls extending between said first and second fold lines, a second said sidewall extending between said second and third fold lines, the other of said top and bottom walls extending between said third and fourth fold lines, and a securing flap extending between said fourth fold line and said second end edge, said blank being folded into a generally hollow rectangular tube so that said securing flap overlaps said first sidewall and is fixedly secured thereto, said securing flap having openings therein which align with the corresponding openings formed in the sidewalls of the stringer.

19. A stringer according to claim 18, including vertical reinforcing means provided inside said tube adjacent the ends thereof, said vertical reinforcing means being disposed between the sidewalls of the stringer and extending vertically between the top and bottom walls thereof for providing vertical support therebetween.

20. A stringer according to claim 14, including interlock means cooperating between the opposed overlapping flaps when disposed in the interior of the stringer for securing the overlapping flaps together in the inwardly folded position.

21. A stringer according to claim 20, wherein said interlock means includes an opening formed through one of the overlapping flaps adjacent the free end thereof, and an outwardly projecting tab formed adjacent the free end of the other overlapping flap, said tab being inserted into said opening when the overlapping flaps are in the inwardly folded position within the interior of the stringer.

22. A stringer according to claim 14, wherein each said flap has a height which substantially corresponds to the interior vertical spacing between the top and bottom walls of the stringer so that upper and lower edges of the flap are disposed in contact with the respective opposed top and bottom walls of the stringer when the flap is folded into the interior of the stringer.

23. A horizontally elongated pallet stringer, comprising a monolithic one-piece blank of corrugated paperboard cut, scored, folded and erected to define a substantially horizontally elongate, substantially hollow tube of rectangular cross-section comprised of two spaced-apart, parallel, opposed upright sidewalls with a top wall extending substantially horizontally between upper edges of said sidewalls and a bottom wall extending substantially horizontally between lower edges of said sidewalls and extending substantially parallel with said top wall, said two sidewalls each having at least two foldable flaps each bounded by an upright fold line along an upright edge thereof and cut lines along another upright edge thereof and along upper and lower edges thereof, said flaps being foldably positioned so as to extend substantially transversely of their respective sidewalls inside said stringer, said flaps having a height so as to extend between said top and bottom walls in vertical load supporting relationship therebetween when said flaps are folded inside said stringer, said two flaps as associated with each said sidewall defining two openings which extend sidewardly through said stringer with the two openings in one said sidewall being aligned with the two openings in the other said sidewall, the openings in said stringer being spaced-apart a distance corresponding to the spacing between the support bars of a forklift truck so that the stringer can be lifted by a forklift truck.

24. A stinger according to claim 23, including mechanical interlock means for securing the overlapped flaps together when folded inside the stringer.

25. A pallet assembly according to claim 23, wherein each said flap has a height which substantially corresponds to the interior vertical spacing between the top and bottom walls of the stringer so that upper and lower edges of the flap are disposed in contact with the respective opposed top and bottom walls of the stringer when the flap is folded into the interior of the stringer.

26. In a pallet having a deck and at least one horizontally elongated stringer fixed to the deck and projecting downwardly therefrom, the improvement wherein the stringer is constructed substantially entirely of corrugated paperboard, comprising a monolithic one-piece blank of corrugated paperboard cut, scored, folded, and erected to define a substantially horizontally elongate, substantially hollow tube of rectangular cross-section comprised of two, spaced-apart, parallel, opposed upright sidewalls with a top wall extending substantially horizontally between upper edges of said sidewalls and a bottom wall extending substantially horizontally between lower edges of said sidewalls and extending substantially parallel with said top wall, said two sidewalls each having two pairs of rectangular flaps bounded by two upright fold lines along mutually remote upright edges thereof and cut lines along adjacent upright edges thereof and along upper and lower edges thereof, said flaps being folded inwardly so as to extend substantially transversely of their respective sidewalls inside said stringer so as to extend between said top and bottom walls in vertical load supporting relation therebetween, each of the inwardly folded flaps of each pair in one said sidewall being disposed in overlapping relation to one of the inwardly folded flaps associated with the other sidewall, said pairs of inwardly folded flaps as associated with said sidewalls defining two openings which extend sidewardly through said stringer, the openings in said stringer being spaced-apart a distance corresponding to the spacing between the support bars of a forklift truck so that the stringer can be lifted by a forklift truck, and vertical reinforcing elements provided inside said hollow tube adjacent the ends thereof, said vertical reinforcing elements being disposed between the sidewalls of the stringer and extending vertically between the top and bottom walls thereof for providing vertical support therebetween.

27. A pallet according to claim 26, including an interlock cooperating between the overlapping inwardly folded flaps for securing the overlapping flaps together in the inwardly folded position.

28. A pallet assembly comprising a pair of parallel, spaced-apart, elongated end stringers each being defined by a monolithic one-piece blank of corrugated paperboard cut, scored, folded, and erected to define a substantially hollow, rectangular cross-section comprised of two, spaced-apart, parallel, opposed vertical sidewalls with a top wall extending substantially horizontally between upper edges of said sidewalls and a bottom wall extending substantially horizontally between lower edges of said sidewalls and extending substantially parallel with said top wall, and a substantially flat top deck extending substantially horizontally between said end stringers and fixedly joined to the top walls thereof, said stringers projecting downwardly from said top deck, each of said two sidewalls of each stringer having at least one rectangular flap bounded by an upright fold line along a first upright edge thereof and a cut line along a second upright edge thereof and along upper and lower edges thereof, said flaps of said two sidewalls being foldably positioned in an inwardly folded position so as to (1) extend substantially transversely of their respective sidewalls inside said stringer in an overlapping manner and (2) extend between and provide vertical load support between said top and bottom walls, said overlapping flaps defining aligned openings through said two sidewalls, and an interlock cooperating between said overlapping flaps when disposed inside said stringer and securing said overlapping flaps together in said inwardly folded position.

29. A pallet assembly according to claim 28, including vertical reinforcing elements provided inside each said stringer adjacent the ends thereof, said vertical reinforcing elements being disposed between the sidewalls of the stringer and extending vertically between the top and bottom walls thereof for providing vertical support therebetween.

* * * * *

UNITED STATES PATENT AND TRADEMARK OFFICE

CERTIFICATE OF CORRECTION

PATENT NO. : 5 377 600

DATED : January 3, 1995

INVENTOR(S) : Scott SPEESE, et al

It is certified that error appears in the above-indentified patent and that said Letters Patent is hereby corrected as shown below:

On the title page, item [63] line 4; change "abandoned," to ---abandoned.---.

line 5; delete "which is a continuation-in-part of Ser. No. 823,296,"

line 6; delete "May 28, 1992."

Column 17, line 57; change "tubed" to ---tube---.

Column 18, line 1; change "reinforcing" to ---support---.

line 1; change "support" to ---reinforcing---.

line 38; after "stringer" insert ---,---.

Column 20, line 10; after "stringer" insert ---so as to project inwardly generally toward one another and overlap and abut when folded inside said stringer---.

Signed and Sealed this

Twentieth Day of June, 1995

*Attest:*

Bruce Lehman

BRUCE LEHMAN

*Attesting Officer*

*Commissioner of Patents and Trademarks*